United States Patent [19]

Paterson et al.

[11] Patent Number: 5,026,053

[45] Date of Patent: Jun. 25, 1991

[54] BILLIARD TABLE MULTIPLE ELECTRONICS GAME DEVICE AND METHOD

[75] Inventors: William D. Paterson; John Wester; Norman L. Pulliam, all of Calgary; Henning von Eyben, Kelowna, all of Canada

[73] Assignee: Entertainment International, Inc. 1987, Kelowna, Canada

[21] Appl. No.: 458,076

[22] Filed: Dec. 28, 1989

[51] Int. Cl.[5] ..... A63D 15/00; A63D 15/20

[52] U.S. Cl. ..... 273/3 R; 273/14; 273/11 R; 273/2

[58] Field of Search ..... 273/2, 3 R, 3 A, 11 R, 273/11 C, 12, 14, 59 R, 59 B, 87 B, DIG. 26

[56] References Cited

U.S. PATENT DOCUMENTS

| | | | |
|---|---|---|---|
| 4,140,220 | 2/1979 | Hazeltine et al. | 273/11 R |
| 4,355,802 | 10/1982 | Sargent | 273/11 R |
| 4,516,770 | 5/1985 | Brookes et al. | 273/11 R |
| 4,524,969 | 6/1985 | Erzmoneit | 273/3 R |
| 4,878,664 | 11/1989 | Brookes | 273/3 R |
| 4,882,676 | 11/1989 | Van De Kop et al. | 273/14 |
| 4,948,128 | 8/1990 | Emery, II et al. | 273/11 R |

FOREIGN PATENT DOCUMENTS

| | | | |
|---|---|---|---|
| 2592808 | 7/1987 | France | 273/2 |
| 2158360 | 11/1985 | United Kingdom | 273/11 R |

*Primary Examiner*—Edward M. Coven
*Assistant Examiner*—Jessica J. Harrison
*Attorney, Agent, or Firm*—George M. Cole

[57] ABSTRACT

A table game (10) device and method having a playing surface (20) and electronic display (90). A plurality of pocket openings (24–34) numbering six or other number, as in a standard six pocket billiard table (10), with individual switching and signal generating means (46) are provided. Switching or signal generating means (46) generate signals to be processed by electronic computer control means (56, 70, 80). Each pocket opening is assigned a different game or sport play action at specified intervals such as after each play on the table surface. Scoreboard display (90) has a lighted animated display showing a field, arena or playing environment for the game or sport selected and being played. Advertizing and promotional materials may be shown on the displayer (90) between plays and games.

9 Claims, 6 Drawing Sheets

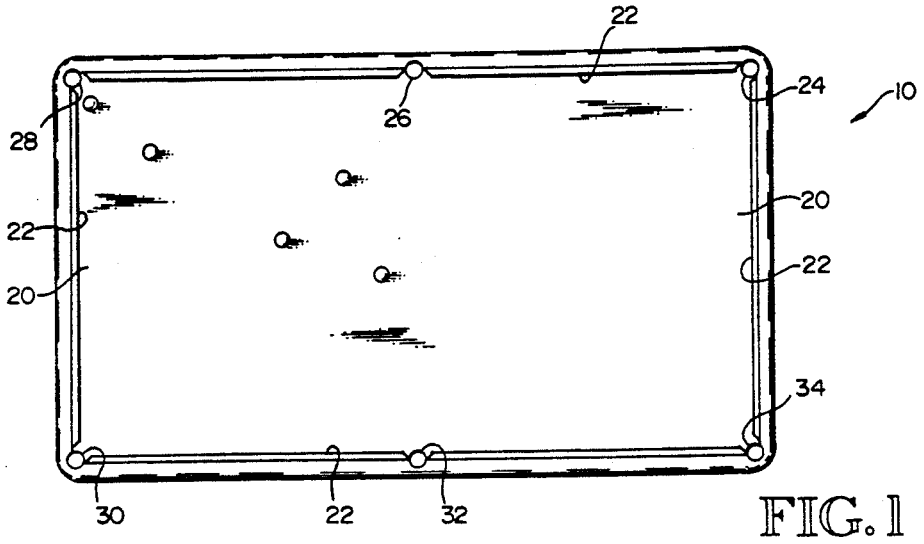
FIG. 1
FIG. 2
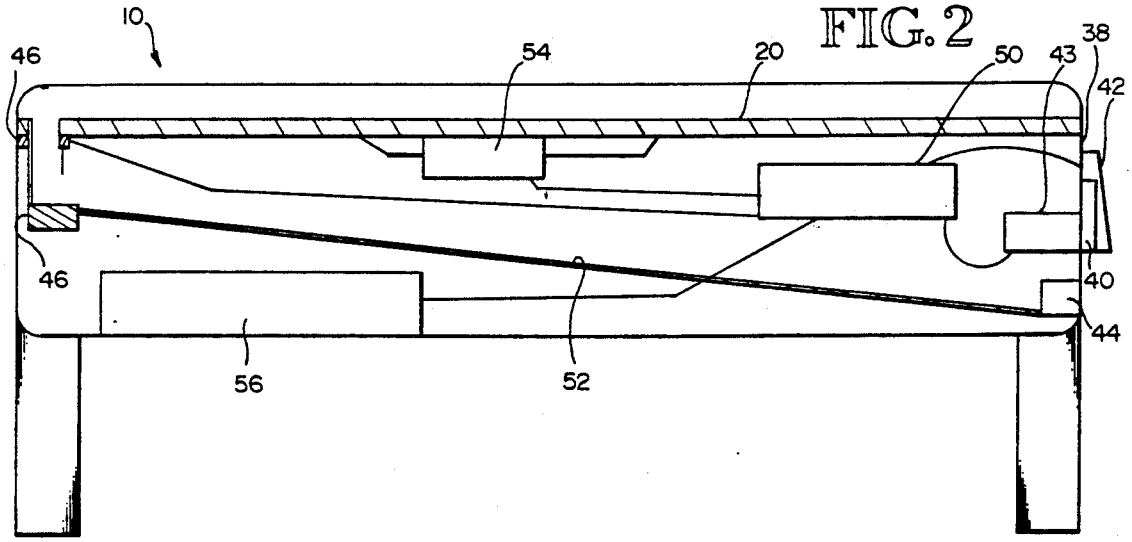
FIG. 3
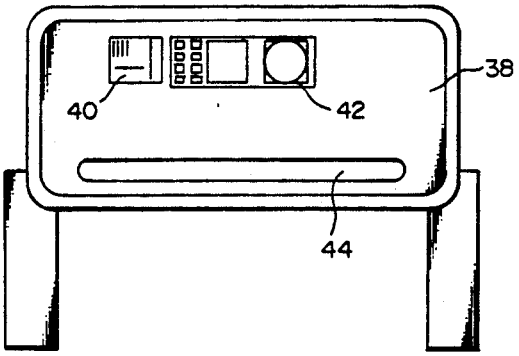
FIG. 4
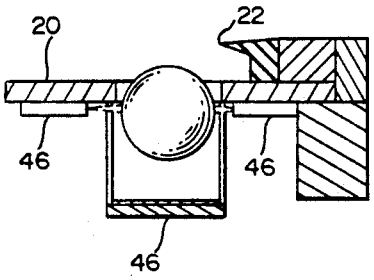

BILLIARD TABLE MULTIPLE ELECTRONICS GAME DEVICE AND METHOD

DESCRIPTION

1. Technical Field

The invention relates to the field of electronic games in combination with video images of the games action, and more particularly to a device and method for multiple electronics games played in combination with a pocket billiards table. This application references copending U.S. patent application Ser. No. 333,875, filed Apr. 3, 1989, now abandoned.

2. Background Art

As many people are aware an enormous variety of electronics games are found in video arcades, airport terminal, buss stations, restaurants, taverns and bars, games rooms of hotels and in the home. Many, of course, are programmed electronics games featuring a video screen with animated objects and images on the screen. A typical object of a game is to fire a weapon which shows on the screen. The weapon is controlled by hand or finger manuipulated lever, button or wheel. The variety of the games is literally endless.

Another type of game is the pin ball machine with which most people are familiar, the purpose of which is to accumulate point scores by bouncing a steel ball off or through as many of a series or score recording objects and obstacles as possible before it falls into a hole and out of play. Electronically scored football, soccer and bowling games are also commonly found in leisure time stores, parlors and amusement arcades.

The only art of which applicant(s) are aware are the following: U.S. Pat. No. 3,275,322 to Burnside showing an amusement device in which a hole 23 on the playing surface receives a ball which in turn closes a switch 138 to generate an electrical signal (see FIG. 11 and column 4, lines 47–54).

U.S. Pat. No. 2,470,325 to Stillman also shows a multiple game surface having a plurality of holes. Projections 22 are provided on the under face of playing surface 4 and are engaged by a ball falling through hole 7 to actuate a microswitch 21 (see column 2, lines 35–41).

U.S. Pat. No. 2,689,129 to Hooker shows an electrical display and score board and U.S. Pat. No. 1,508,117 shows a baseball games using holes in a playing surface. Lastly, an article, 'Pinball Pokerino' by John Michails, MECHANICS ILLLUSTRATED, Vol. 23, No. 471, Aug. 1967, pp 96–98, shows a game utilizing simple switches installed on the underside of the game surface so that a switch is closed when a ball falls through.

None of the above disclosures, either structurally or in operating principles, anticipates the claimed subject matter of the instant invention.

DISCLOSURE OF THE INVENTION

The invention comprises a standard six pocket billiard type table of regulation size, but which could be a nonstandard four pocket or other configuration. The pocket represent plays of a game such as baseball or hockey, or plays of other sports designed into the electronics programming. The specific sport selected for playing has a full gamut of plays stored in memory which are called up randomly after each play and assigned to the pockets. The table itself may be played as billiards, pool, snooker or other variation of games played with billiard and cue balls and shot with a cue stick. A player attempts to get the ball to a pocket representing a play, for example, as in baseball, which advances or scores a runner. Each opening is provided with a switching mechanism so that as a ball falls through an opening to a pocked an electrical signal is generated. The signal is processed by the computer controls and applied to game scoreboard and display circuits. Means are provided to determine whether a ball in a pocket is valid or if there is a shot on the table surface but no ball is pocketed. A scoreboard is mounted as desired such as above the table or on a nearby wall to present a visual display of the game as the individual balls are shot by cue stick to try and make scores for the particular sport selected.

Accordingly, it is among the many features of the invention to provide a multiple electronics game combination of billiards or pool and any one of many other sports and games designed into the electronics. The invention is unique but easy to understand in any country in which pool, billiards, snooker and/or other variation of games played on a billiards table with balls and a cue stick. The electronic controls are programmed to a wide variety of sports and games but in any event the game requires and is dependent on skill as well as luck. The electronics controls in combination with the conventional tabled structure comprise a new and novel game for the home and leisure and amusement industry. The game system of this invention can be retrofited to existing tables as well as installed in new tables. The scoreboard and action displays monitors can also be disigned to carry advertizing and promotional visuals and sounds as well as game actions and audios.

BRIEF DESCRIPTION OF THE DRAWINGS

FIG. 1 is a top plan view of a standard six pocket table;

FIG. 2 is an elevational cross section view through the long dimension of the table;

FIG. 3 is an end view of the table;

FIG. 4 is a partial cross section view of a pocket switch means for generating an electronic signal;

BEST MODE FOR CARRYING OUT THE INVENTION

Figure 5:
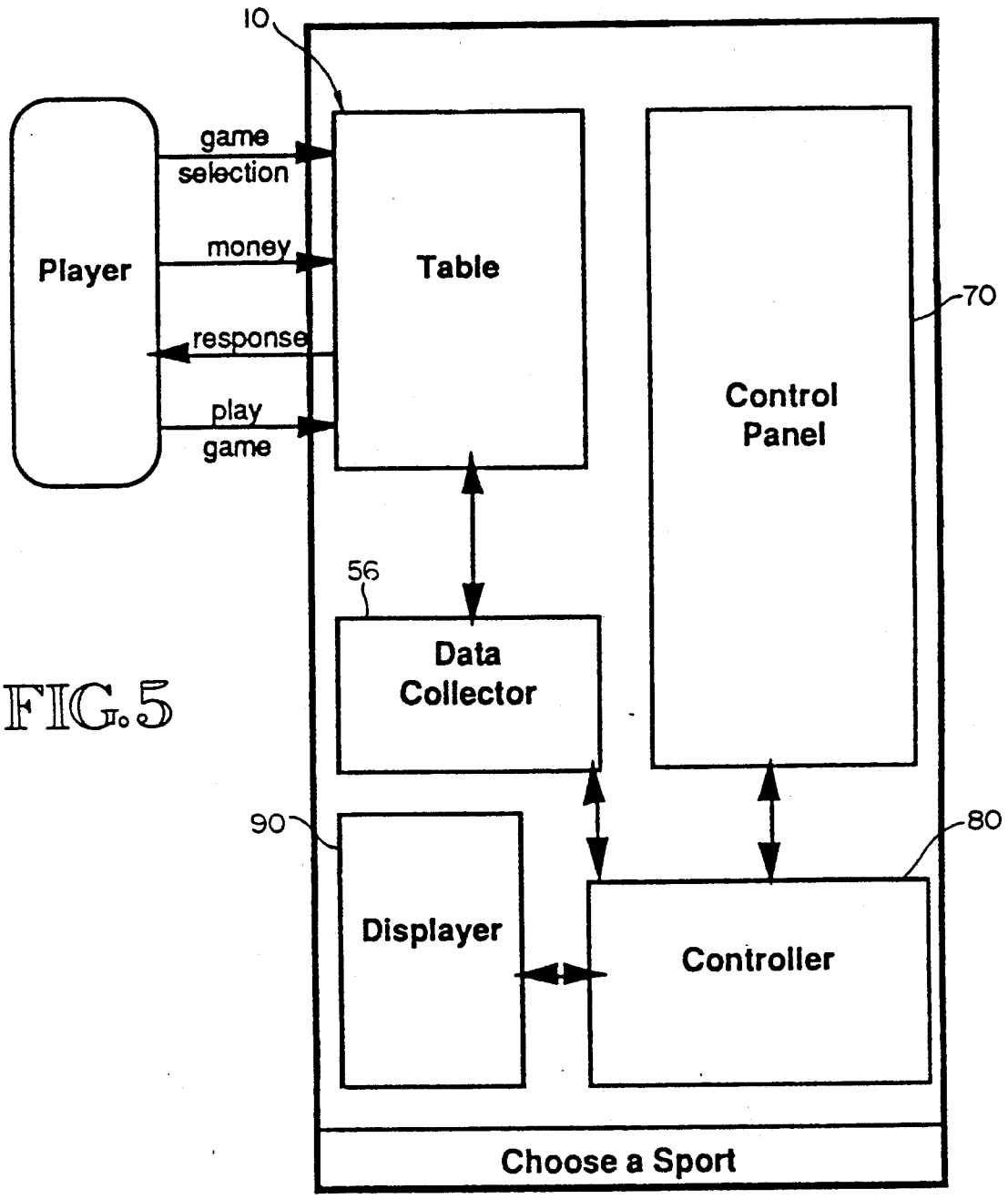
FIG. 5 is a block diagram of the major circuit components of the game system.

Referring now to the drawings it will be seen in FIGS. 1–4 that a table, generally designated by the number 10, is a typical floor supported, standard six pocket billiard table. Table 10 has rectangular planar playing surface 20 which will be felt covered and have raised side edges or cushions 22 on all four sides of the playing surface. Six pocket openings at the corners and at the mid-point of the long sides are numbered 24, 26, 28, 30, 32 and 34 as indicated.

Details of the table in FIGS. 2–5 show that table 10 has end 38 with money receiver 40 having collector reservoir 43 and sport selection panel 42. A ball return receiver opening or shelf 44 is provided for collecting balls which have been played. Signals for scoring and or displays will be generated by a ball falling into a pocket 24–34 and tripping switch mechanism 46. Switch 46 may be a photoelectric device which, when the light beam is broken by a ball passing through the opening, causes an 'on' condition and generates a signal. Alternatively, the object or ball detection device or switch 46 may be an electro-mechanical unit which generates a signal when a ball falls on it. Also, the ball detection means could be a magnetic constituent within the ball itself which activates the switch mechanism.

The arrangement of parts of the system within table 10 are shown in the cross section view of FIG. 2. Ball detection device 46 includes means 50 for identifying whether or not a ball is valid and therefore to be scored. The ball type recognizer means 50 could, for example, be a color discriminator circuit for identifying a ball as valid or invalid. Again, it could be a circuit for recognizing a magnetic field from the ball itself. The ball passes from a pocket via ramp 52 to ball collector shelf 44. In addition the table will be equipped with a ball motion detector circuit 54 for sensing ball movement on the table playing surface 20. Such detection means could be a vibrations sensor, acoustic sensors or circuitry to respond to the movement of balls which are provided with a magnetic constituent.

Figure 6:
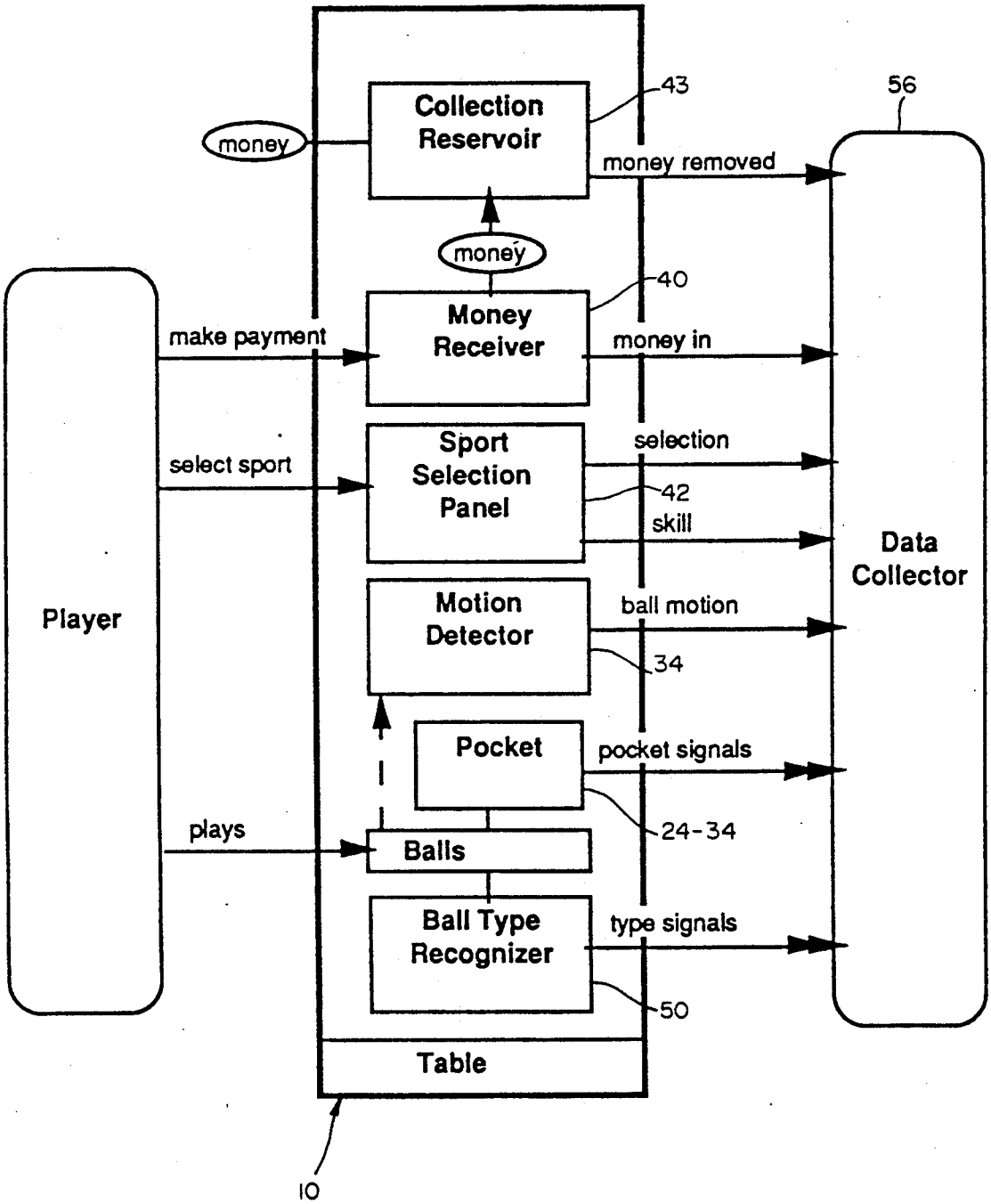
FIG. 6 is a block diagram of the sub-components of the table.
Figure 7:
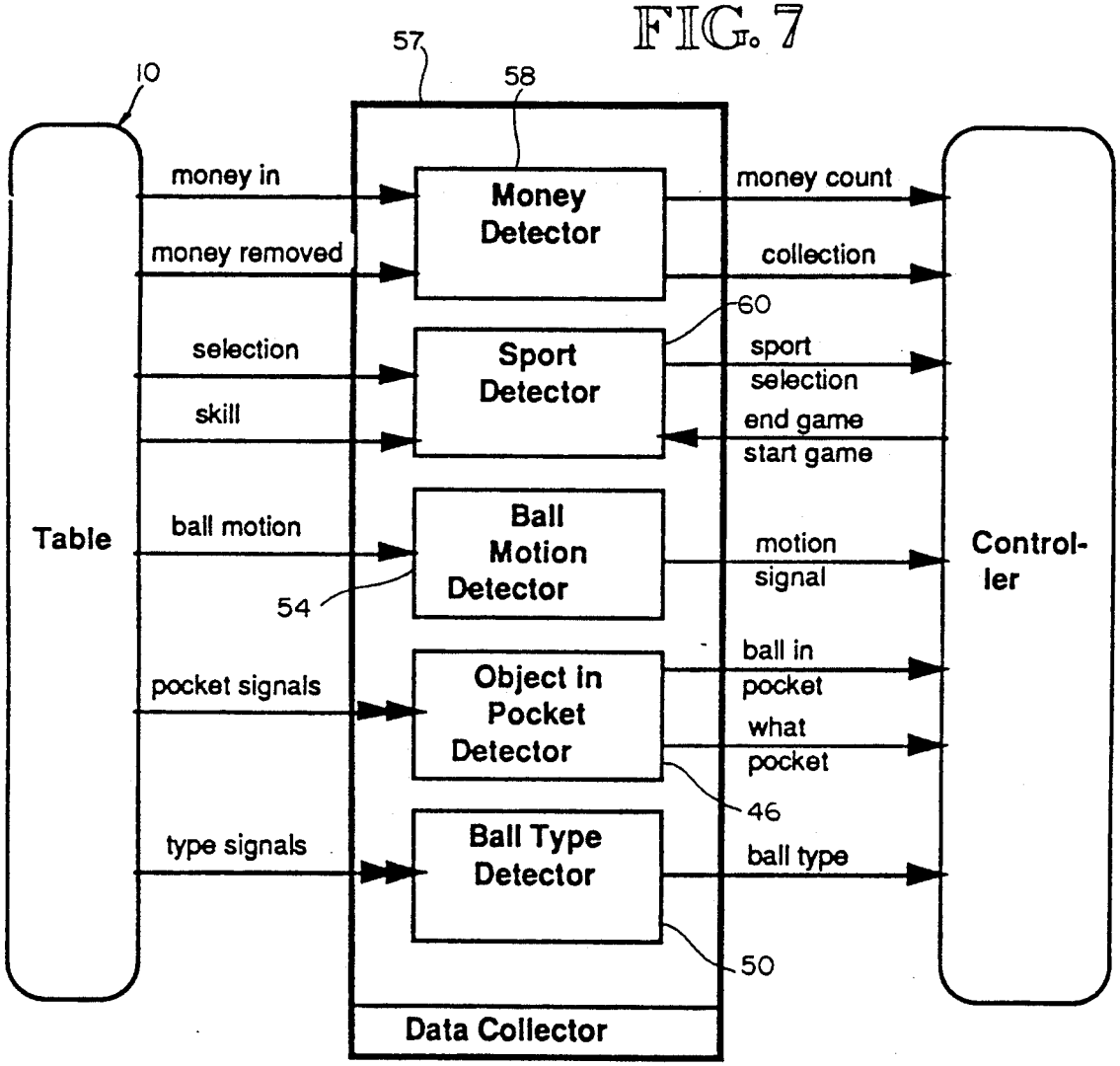
FIG. 7 is a block diagram of the circuit sub-components of the data collector.

FIGS. 5 and 6 show in block diagram form the major circuit components of the electronic system of this invention. To repeat a portion of the above description, table 10 includes data collector 56 which with other modules is incorporated in the table structure and controls the game operations. Its essential function is to store game rules and actions in memory, receive signals from the various sensors, and convert data signals from analog to digital form for transmission to the controller and central processing unit 60. The game system of this invention may include any number of sports for the sports selection module 42 and for programming into the electronics controls. Besides baseball, basketball, hockey, football and soccer as the more obvious examples, the game device may include but not be limited to archery, bingo, boxing, boat racing, bull fighting, cricket, darts, golf, harness racing, polo, ping pong, trivial games, track meets, wrestling and water polo to name but a few of the myriad number of games or sports which may be programmed into the game system.

Data collector 56 includes among its sub-component circuits detector 58 for receiving signals when money is inserted in receiver 40 and informs the controller that such event has taken place. A sport detector component 60 controls operation of sport selection panel 42 and receives the signals from selector panel 42 which signal is then processed for transmission to the controller. It will be appreciated that the controls may also include a selector for players' skill level such as basic, intermediate and expert, along with the sport chosen for play. Ball motion detector 54 as described supra, senses whether balls have moved on the playing surface and prepares that signal to be sent to the controller. The ball detection circuitry 46 determines if an object or ball has dropped into a particular numbered pocket. Finally, ball discriminator component 50 tells the controller whether there has been a valid play.

Figure 8:
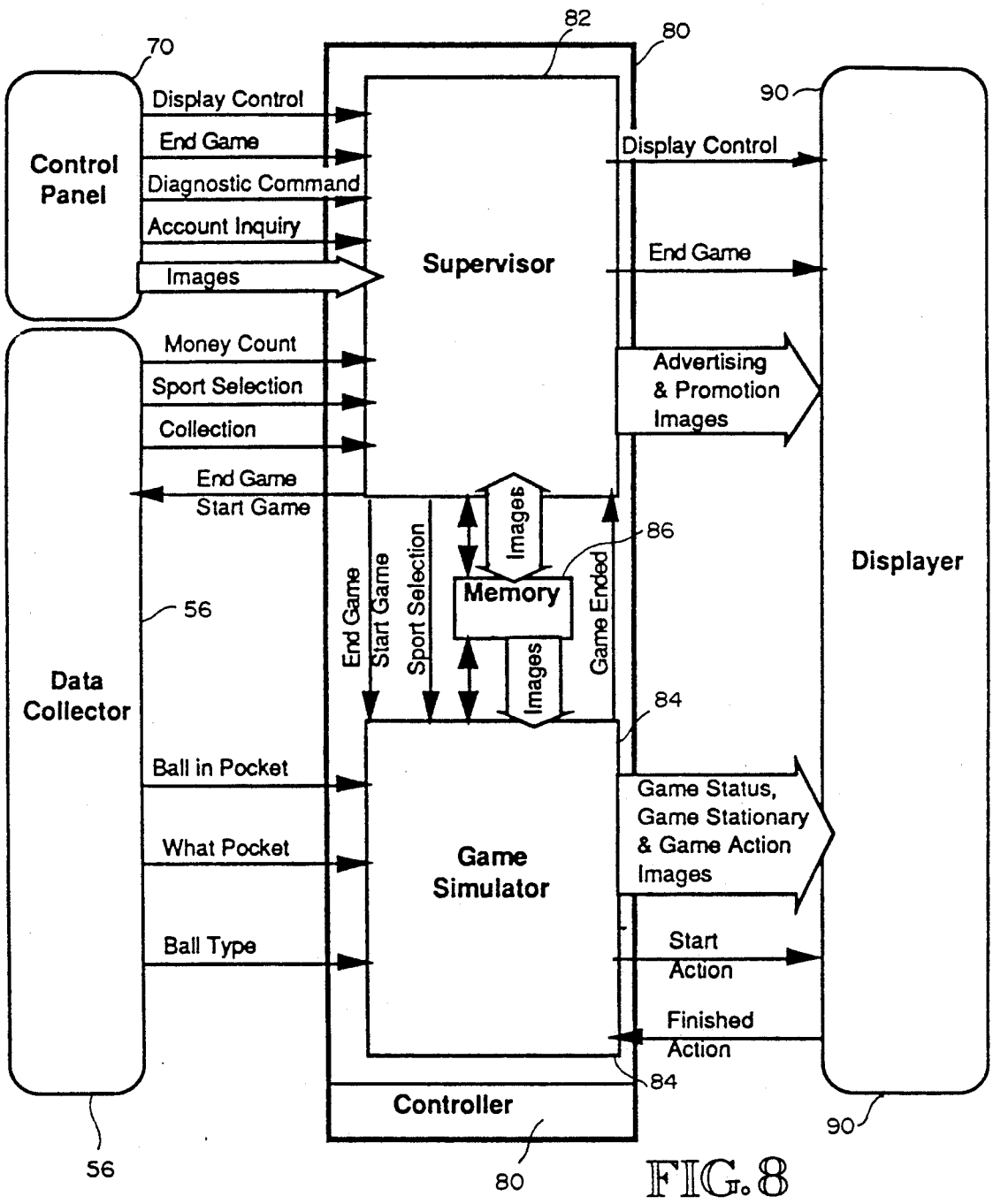
FIG. 8 is a block diagram of the circuit sub-components of the controller.
Figure 9:
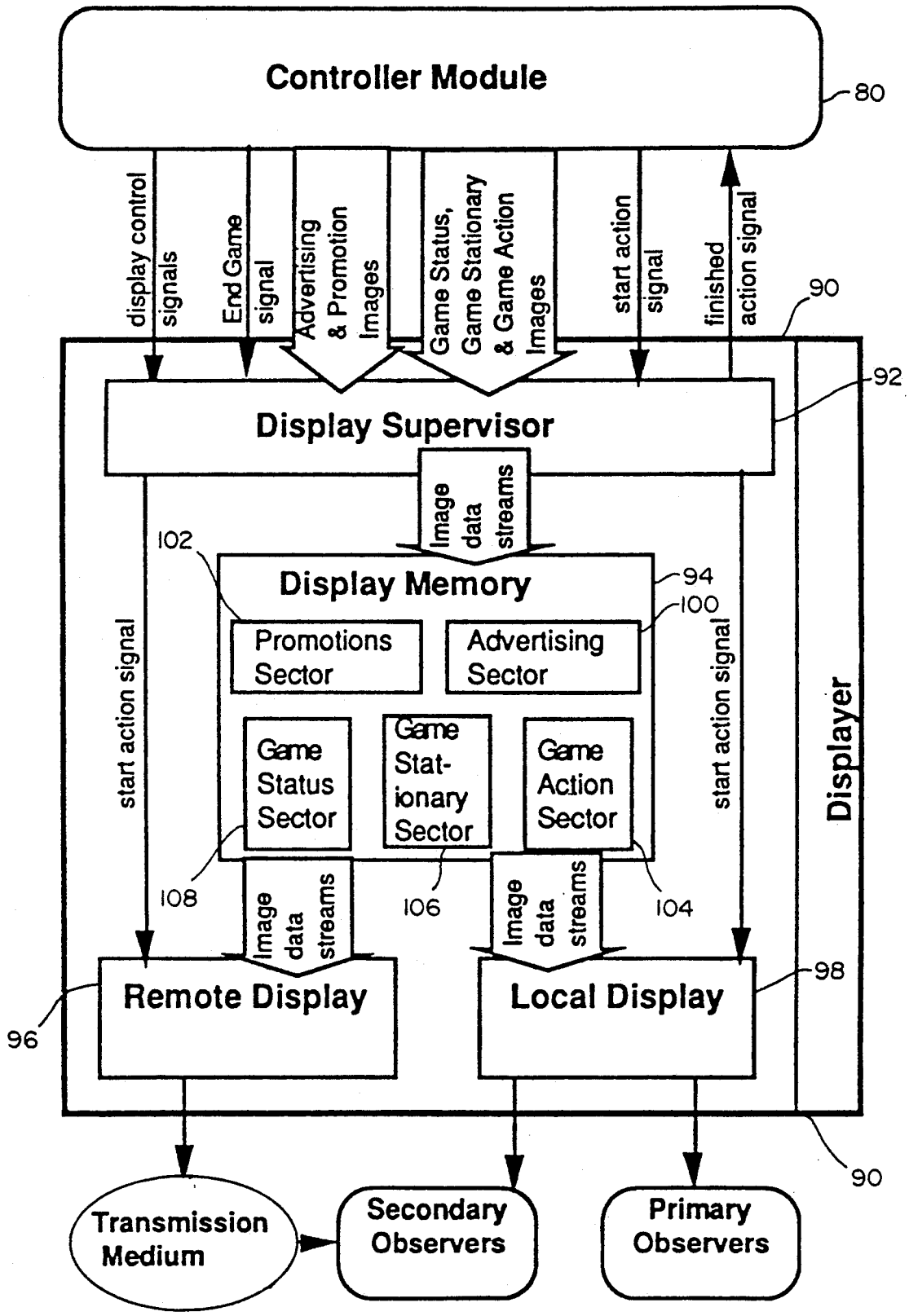
FIG. 9 is a block diagram of the circuit sub-components of the display module.

FIGS. 5 and 8 show control panel component 70 which can be located in the table 10 or in a nearby storage or utility closet in close proximity to the table. It will translate command actions into electronic signals and transmit them to the controller or to the component to which the command relates. Inputs to the control panel will or may originate from a remote head office network and will basically be responsible for administrative inputs such as, for example, images to be shown on the displayers, accounting functions, diagnostic commands and other display controls.

The controller 80 is as its name implies the central processor unit of the invention in that it controls and supervises the operations of the electronics. It may be located in the table or in a protected place such as a utility closet nearby and connected by cable or UHF transmitter to the electronics within the table. Controller 80 interfaces with control panel 70 and data collector 56 for input information.

A supervisor sub-component 82 controls operation of other components and sub-circuits and thus the game system itself. FIG. 8 shows the inputs received by supervisor module 82 from the control panel 70 and data collector 56, including but not limited to money count, sports selector, 'start' and 'end' game signals and sensors located on the table for identifying events occurring on the table.

Controller 80 also includes a game simulator portion 84 which controls game simulation. It accepts input from the data collector 56 and supervisor 82 and transmits game status, game stationary and game action images to individual or multiple display components 90. Besides game simulation the controller 80 calls on its permanent and temporary memory 86 for programmed games rules, actions and events in a current game and any other data required by the controller for playing a particular sport. Memory, as those skilled in the art are aware, will be high capacity devices such as hard, floppy, laser and compact discs and ROM's and RAM's as needed.

The displayer module 90 is controlled from the CPU or controller 80 so that the display monitors present action for the sport chosen. It projects scores and animated pictures and sounds of an electronically simulated game programmed to be played on a pocket billiard table surface. The electronic controls are designed to present advertizing and promotional pictures and sound to person near a given billiard table entertainment facility. The video display monitors can be suspended over or secured to the ceiling over the table, attached to a nearby wall, or positioned as a free standing unit near the table.

The displayer component 90 will include display control or supervisor sub-circuit 92, display memory sub-component 94 and local and remote display video/audio screens 96 and 98. It will be noted that display memory 94 will include advertizing and promotions sections 100 and 102 respectively as well as game 'status', game 'stationary' and game 'action' sections 108, 106 and 104 respectively. Display supervisor 92 receives control signals and digital data streams from controller 80 and when it receives a 'start' action signal, it will interrupt local display 98 and remote display 96 in order to display the next game simulation segment. Display supervisor 92 will also control sequencing of advertizing and promotional graphics on the display screens. Memory 102 will be one or a plurality of devices such as random access memories or RAM's.

Visual display devices 96 and 98 will be television monitors, thin screen TV monitors, projection TV monitors, LED arrays and/or holographics projector means.

An example of the scoreboard controls using baseball as the selected sport would be a pocket identified as a 'one base hit' or single. A ball in that pocket causes the display to show that a runner on third will score, the batter will advance to first base and, if there was a runner on first he will advance to second base. The above moves would be controlled the controller 80 and would reflect on the scoreboard display by lights or animated figures. For instance, the at home plate will advance to first by a series of lights or animated images moving sequentially and giving the visual effect of a runner moving from one base to the next. It will be understood that the electronic controls may randomly assign a combination of plays to the numbered playing table pockets such as 'single', 'bunt', 'strike out', 'ground out', 'fly out,' and 'foul' for a particular play. As soon as the that ball is played the controls will assign a combination of six new play designations to the six pockets for the next ball to be played. The scoreboard display will show the play assignments to the numbered pockets.

Once a ball has been pocketed, the ball type discriminator circuit 50 will tell the controller whether the ball is a valid one, that is if the ball generates an acceptable signal, and if so that the signal generated is to be processed by the electronic controls. The signal will be processed and the shot will portray the result on the scoreboard display graphics. The controller will keep score and count statistics such as balls, strikes, outs, balls as well as which player is shooting.

We claim:

1. Electronic table game device combining features of a pocket billiards table and multiple, selectable electronics sports and games, comprising:

(a) a pocket billiards table with a planar playing surface substantially rectangular in shape and having side portions with raised, continuous cushioned edges around said rectangular playing surface and further including a predetermined number of ball pocket openings, (b) each of said pocket openings being provided with an electrical signal generating means so that as a ball drops through a pocket opening an electrical signal is generated, (c) said table being provided with electrical computer control means including a valid ball discriminator circuit to determine whether a ball falling through a pocket opening generates a valid and acceptable signal, said computer control means also including memory circuit means for storing rules for the various games and sports to be played and memory circuit means for temporary storage for game information input, and further including random play assigning circuit means for assigning play designations to each of said pocket openings at predetermined intervals, (d) a visual electronic scoreboard and game display means supported near said table playing surface including a game or sport design thereon with player identifications and further including electronic control means for receiving signals from said ball openings and displaying different game and sport play selections for each of said openings, said scoreboard display through said electronic control means displaying game beginning and ending, player identifications, scoring and game progress information.

2. The electronic table game device according to claim 1 and wherein said table is provided with ball motion sensing means whereby motion of a ball on said playing surface is detected.

3. The electronic table game device according to claim 2 and wherein a game and sport selection panel is provided at one end of said table.

4. The electronic table game device according to claim 3 and wherein said game and sport selection panel includes a player skill level selection means.

5. The electronic table game device according to claim 4 and wherein said scoreboard and game display means and said electronic control means include subcomponent controls for visually displaying advertizing, promotional and other preselected information as desired.

6. The electronic table game device according to claim 1 and wherein a game and sport selection panel is provided at one end of said table.

7. The electronic table game device according to claim 6 and wherein said game and sport selection panel includes a player skill level seletion means.

8. The electronic table game device according to claim 1 and wherein said scoreboard and game display means and said electronic control means include subcomponent controls for visually displaying advertizing, promotional and other preselected information as desired.

9. In a method of playing multiple electronics sports and games on a pocket billiards type table having a predetermined number of ball pocket openings, said table having a rectangular playing surface and raised, continuous cushioned edges around said playing surface and further including electronic computer control means for said table, the steps comprising:

(a) providing each of said pocket openings with electrical signal generating means so that as a ball drops through a pocket opening an electrical signal is generated, (b) selecting a sport or game to be played on said device, (c) using said electrical signal from said pocket opening to initiate a play for said game or sport, (d) determining with said control means if a ball dropping through a pocket opening is a valid and acceptable ball for playing, (e) storing rules and input information for various games and sports in said electronics control means, (f) assigning with said control means play designation to the pocket opening of said table at predetermined intervals, (g) electronically displaying game and sport information on a visual electronics display scoreboard as a result of a play on said table, including: displaying a representation of the game or sport field or arena of play, player identifications, game beginning and ending, scores and game progress.

* * * * *